175-40
10/13/81 XR 4,294,318
SR

United States Patent [19]
Desbrandes et al.

[11] 4,294,318
[45] Oct. 13, 1981

[54] DEVICE FOR MEASURING THE STRESSES APPLIED IN USE TO THE DOWNHOLE ASSEMBLY OF A DRILL PIPE

[75] Inventors: Robert Desbrandes, Sevres; Pierre Grolet, Orgerus, both of France

[73] Assignee: Institut Francais du Petrole, Rueil-Malmaison, France

[21] Appl. No.: 86,607

[22] Filed: Oct. 19, 1979

[30] Foreign Application Priority Data

Oct. 19, 1978 [FR] France ..... 78 30026

[51] Int. Cl.[3] ..... E21B 47/00
[52] U.S. Cl. ..... 175/321; 73/151; 73/862.35; 175/40
[58] Field of Search ..... 175/40, 321; 73/136 B, 73/136 A, 136 C, 151; 340/853

[56] References Cited

U.S. PATENT DOCUMENTS 3,311,180 3/1967 Gilreath et al. ..... 175/321
3,319,726 5/1967 Brown ..... 175/321
3,329,221 7/1967 Walker ..... 175/321
3,447,340 6/1969 Garrett ..... 175/321
3,664,184 5/1972 Dyer ..... 73/136 B
3,686,942 8/1972 Chatard et al. ..... 73/151
3,696,332 10/1972 Dickson, Jr. et al. ..... 175/104
3,855,853 12/1974 Claycomb ..... 73/151
3,876,972 4/1975 Garett ..... 73/136 B

*Primary Examiner*—James A. Leppink
*Attorney, Agent, or Firm*—Millen & White

[57] ABSTRACT

This device comprises a resilient stress-responsive member interconnecting two conduits which can be respectively coupled to upper and lower portions of the downhole assembly, and are surrounded by a protecting sleeve making up with one of said conduits, the lateral walls of an annular space. Annular elements secured to a first of said lateral walls, and slidable on the second of said lateral walls, form the end walls of said space and an intermediate annular piston integral with the second lateral wall, and slidable on the first lateral wall, divides the annular space into two annular chambers communicating respectively with the inner and outer spaces of the downhole assembly of the drill string, and having operative cross sections selected so as to compensate for the axial loads due to the hydrostatic pressure and bottom effect applied to the stress-responsive member.

3 Claims, 3 Drawing Figures

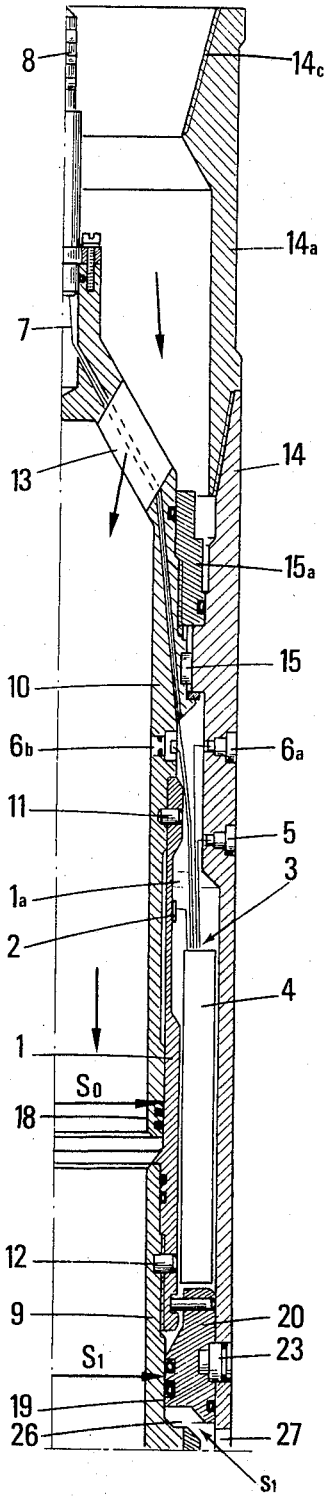
FIG.1
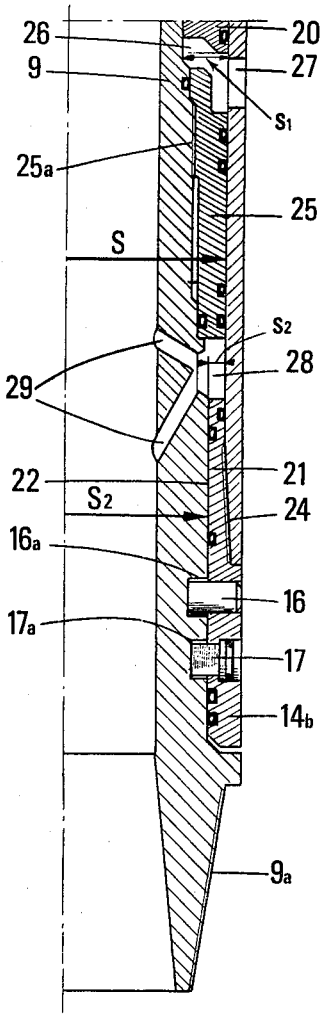

DEVICE FOR MEASURING THE STRESSES APPLIED IN USE TO THE DOWNHOLE ASSEMBLY OF A DRILL PIPE

BACKGROUND OF THE INVENTION

The present invention relates to a new device for measuring the stresses applied in use to the downhole assembly of a drill pipe.

French patent specification No. 2,041,342 which corresponds to U.S. Pat. No. 3,686,942 and U.S. Pat. No. 3,855,853 already describe devices of this type comprising measuring means formed by strain gauges secured to a stress-responsive resilient member, such as a metal sleeve of relatively small thickness which interconnects two conduits respectively coupled to first and second portions of the downhole assembly of a drill pipe.

A protective sleeve integral with one of the conduits protects the stress-responsive resilient member against radial pressure, and safety means limit the relative displacement of the conduits resulting from the stresses applied to the lower end of the drill column, thereby preventing deterioration or breaking of the resilient member as a result of a temporary rise in the applied loads.

These prior art devices are, however, subjected to large high longitudinally directed loads due to the hydrostatic pressure of the drill mud, and to a piston or jack effect resulting from a reduction in the cross-section of flow of the drilling fluid through the downhole assembly of the drill pipe (bottom effect).

For example if, in a wellbore having a 9½ inches nominal diameter no special provision has been made for obviating the above-described drawbacks, a hydrostatic pressure of 600 bars can develop an axial compression load of 70 tons on the stress-responsive resilient member while the forces to be measured are comprised of between 0 and 40 tons. Similarly, the thrust resulting from the above-defined bottom effect may result in an axial traction load of 20 tons when the fluid pressure inside the device exceeds by 200 bars the external pressure, or alternatively, in an axial compression load of 20 tons if the external pressure exceeds by 200 bars the internal pressure.

The measurements performed by the stress-responsive resilient member must accordingly be corrected and the value of the applied correction may greatly exceed the range of the measured values. Such corrections can only be made when the pressures are known with sufficient accuracy, otherwise no measurement can be effected.

SUMMARY OF THE INVENTION

The object of the invention is accordingly, to provide a measuring device of the above-indicated type which is not subjected to longitudinal loads caused by the hydrostatic pressure of the drill mud and to the "bottom effect".

The invention thus makes it possible to reduce to a minimum the useful cross-sectional area so as to obtain the maximum action on the measuring sensors and thus, to provide for the highest possible sensitivity.

BRIEF DESCRIPTION OF THE DRAWINGS

Embodiments of the invention are illustrated by the accompanying drawings wherein:

FIG. 1 illustrates a first embodiment;

DETAILED DISCUSSION OF THE INVENTION

Figure 2:
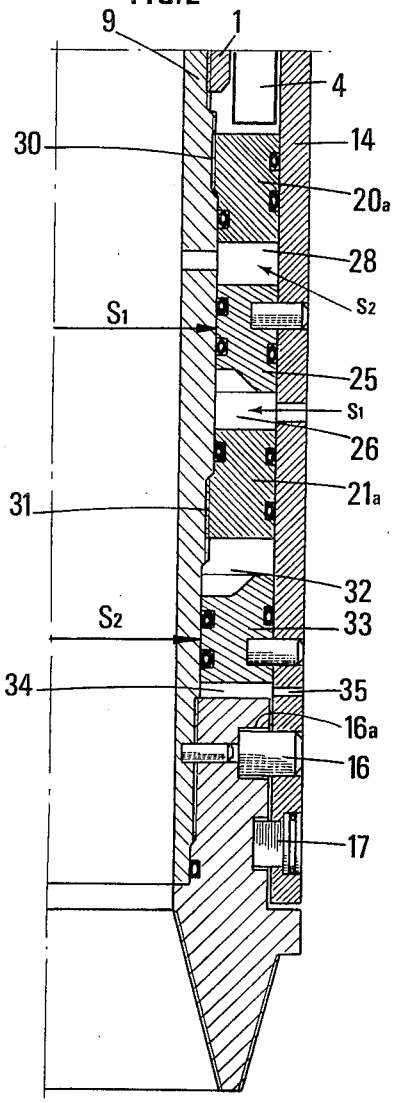
FIG. 2 is a partial view of an alternative embodiment.

In the first embodiment of the invention illustrated in FIG. 1, the upper part of the device is shown on the left side of the drawing and its lower part on the right side. The reference 1 designates a resilient member deformable under the action of the stresses applied to the drill pipe, this member being, for example, a metal tube having at least a portion 1*a* of reduced cross-section so as to be relatively deformable by the traction, compressional and/or torsional stresses applied to the lower part of the drill pipe.

The deformations of this member can be detected by strain gauges 2 which may be of a known type and comprise strain gauges arranged parallel to the axis of the device for measuring traction and compression loads, and strain gauges, placed at right angles to the strain gauges, for measuring torsional stresses. These gauges are electrically connected at 3 to electronic circuits 4 to which are also connected to additional sensors for measuring other parameters at the bottom of the borehole, for example, the sensor 5 for measuring the temperature and the sensors 6*a* and 6*b* for measuring the pressure prevailing respectively outside and inside the downhole assembly of the drill pipe.

The measurements provided by these various sensors are transmitted from the circuits 4 towards the surface through a cable 7 connected to a coaxial plug 8.

When the drill pipe is a flexible pipe embedding electric conductors for data transmission, the plug 8 may be connected to at least one of these conductors.

The device can also be connected to a system for data transmission through pressure pulses produced in the drilling mud, or to any other data transmission system. In this case, suitable electronic circuits will process the measurements or data to make them compatible with the transmission system.

Electric power can be supplied to the circuits 4 by downhole batteries, or through conductors connected to the upper part of the drilled hole. Alternatively, power can be supplied to the device through the transmission system.

The deformable member 1 interconnects two adjacent conduits 9 and 10 to which this member may be, for example, secured through pins 11 and 12. An outer sleeve 14 which may be secured to the conduit 10, through any suitable means comprising for example, the pin 15 and the nut 15*a*, protects the deformable member 1 against the action of external radially directed pressure. The conduit 9 is connected by means of threads 9*a* to the lower portion of the drill string and a mouthpiece 14*a* of the sleeve 14, integral with the conduit 10, is connected by means of threads 14*c* to an upper portion of the drill pipe. The drilling fluid can flow through the conduits 9 and 10, as indicated by the arrow, through ducts, such as the duct 13 provided in the conduit 10.

Annular sealing gaskets protect the portion 1*a* having a small thickness of the deformable member 1, against the drilling mud.

Safety means limit the amplitude of the relative displacement of the conduits 9 and 10 under the action of the loads applied to the lower part of the drill pipe, so as to prevent breaking of the deformable member 1 resulting from accidentally excessive values of the applied stresses (beyond the measuring range).

In the illustrated embodiments, these safety means comprise pins 16 and 17 secured to a mouthpiece 14*b* of the sleeve 14, and traversing slots 16*a* or a groove 17*a*, each leaving, for the pins passing therethrough, a limited clearance in at least one direction (these slots may either be circular with a greater diameter than the pins 16 and 17, or alternatively be ovalized in one direction).

These safety means limit the deformations of the member 1 in a plurality of directions corresponding to the different loads (traction, compression, torsion) applied to the lower portion of the drill column.

When the limit set for the deformation of the element 1 is reached, one of the elements 16 and 17 comes into abutment against the rim of a slot whose profile has been determined as a function of the limit-value tolerated for the deformation of the stress-responsive member 1 by the stresses in each direction of deformation.

This limit-value is fixed at, for example, 40 tons for traction loads and 1000 m.kg for torques applied to the lower portion of the drill pipe, these values being obviously given only as an order of magnitude.

When the limit is reached, the conduit 9 takes over a fraction of the loads which were previously supported by the deformable member 1 alone.

Other safety means may be used for connecting, with a limited clearance, the deformable member 1 to the conduit 9, for instance complementary square threads having limited clearance between each other.

In the different illustrated embodiments, the pipe 9 has, in the vicinity of the end 18 of the conduit 10, a first cylindrical wall portion having substantially the same outer diameter (corresponding to section $S_1$) as the conduit 10 near its end 18 (section $S_0$ of conduit 10).

This equality of the cross-sections nullifies any axial force which would otherwise be developed by the hydrostatic pressure acting on the adjacent ends of the conduits 9 and 10 of the device. In fact, the chamber 1*a*, subjected to the hydrostatic pressure, which contains the electronic circuits 4 and the deformable member 1, has no cross-section exposed to the hydrostatic pressure thereby precluding any piston or jack effect.

The radial loads are supported by the cylindrical parts of elements 1, 9, 10, 14, and the axial loads by the section at the level of the nut 15*a*, at the upper part of the device, and by the annular wall 20 at the lower part, this nut 15*a* and this annular wall 20 both being integral with the same element 14. Moreover the measurements performed with the device according to the invention are free from the influence of the unavoidable reduction in the flow section at the lower part of the drill pipe to which is secured the drill bit, and optionally including a downhole motor driving it in rotation. Due to the difference between the inner and outer pressures at the lower portion of the drill pipe, this reduction in the flow section would result in a downwardly directed thrust which is compensated by the arrangement according to the invention as described below.

The sleeve 14 forms, with the conduit 9, the lateral walls of an annular space limited by two annular elements 20 and 21 which constitute the end walls of this annular space.

One of these elements, element 20, is located at the level of the first cylindrical portion 19 of the conduit 9 and the other element, element 21, is located at the level of a second cylindrical wall portion 22 of the conduit 9 whose outer section is $S_2$. The annular element 20 is secured at 23 to the sleeve 14 and permits the sliding movement of the first external wall portion 19 of conduit 9.

The annular element 21 is secured to the sleeve 14 by means of threads 24 and permits the sliding movement of the second external wall portion 22 of conduit 9.

In the embodiment illustrated in FIG. 1, the annular space between the elements 20 and 21 is divided by the annular piston 25 into a first annular chamber 26 communicating with the space, outside the downhole assembly of the drill pipe, through at least one aperture 27, and into a second annular chamber 28 communicating with the space, inside the downhole assembly of the drill pipe, through at least one aperture 29.

In the embodiment shown in FIG. 1, the annular piston 25 is connected to the conduit 9 through the threads 25*a*, and is sealingly slidable inside the sleeve 14.

Moreover, if S designates the inner cross-section of the sleeve 14 at the level of the piston 25, the area $s_1=S-S_1$ of the operative cross-section of the first annular chamber 26 at the level of the top of piston 25 is, by construction, substantially equal to the area $S_2$ of the outer cross-section of the second cylindrical wall portion 22 of the conduit 9, while the area $s_2=S-S_2$ of the operative cross-section of the second annular chamber 28 is substantially equal to the area $S_1$ of the external cross-section of the first cylindrical wall portion 19 of the conduit 9.

The effects of such an arrangement are as follows:

1st CASE

Let it be assumed that the pressure Pi inside the lower portion of the drill column is greater than the pressure Pe prevailing outside.

A downwardly directed vertical thrust of the value $$(Pi-Pe)\times S_1$$

is applied to the conduit 9 as a result of the reduction in the flow section offered to the drilling fluid resulting from the presence of the drill bit optionally surmounted by a downhole motor.

This force is balanced by an upward vertical force having the value $$(Pi-Pe)\times s_2$$

applied to the piston 25.

These two forces applied to the elements 9 and 25, integral with each other substantially balance each other, since $$s_2=S_1$$

2nd CASE

The pressure Pe outside the lower part of the drill column is greater than the inner pressure Pi.

Therefrom results an upward vertical force of the value $$(Pe-Pi)\times S_2$$

applied to the conduit 9.

This force is balanced by a downward vertical force having the value $$(Pe-Pi)\times s_1$$

applied to the piston 25.

These two forces applied to the same elements 9 and 25 integral with each other, substantially balance each other since $$s_1 = S_2$$

By the arrangement shown in FIG. 1 it is thus possible to compensate for the action on the deformable member 1 of the pressure difference between the inside and outside of the lower portion of the drill column.

It should be noted that in the embodiment shown in FIG. 1 the equality $$S_1 + s_1 = S_2 + s_2$$

is verified.

FIG. 2 is a partial view of an alternative embodiment showing various modifications.

First, the annular elements 20 and 21 of the preceding embodiment are replaced by elements 20*a* and 21*a* respectively, which in this embodiment are integral with the conduit 9 (through the threads 30 and 31 respectively) and are slidable along the inner wall of the sleeve 14, and the arrangement of the annular spaces 26 (communicating with the space outside the lower portion of the drill column) and 28 (communicating with the outer space) is reversed with respect to the piston 25. The latter is, in this embodiment, integral with the sleeve 14 and permits sliding movement of the conduit 9.

Moreover, on the side of the element 21*a*, opposite to the chamber 26, there is provided an annular chamber 32 containing air under atmospheric pressure, this chamber being limited by an annular piston 33 which separates it from another annular chamber 34, communicating through aperture 35 with the inner space of the lower portion of the drilling column.

In the embodiment shown in FIG. 2, the deformable member 1 is protected against the action of the hydrostatic pressure and of the pressure difference between the inner and outer spaces of the lower portion of the drill string by designing the device so that $$S_1 = S_2$$

and $$S_1 \times Pi = s_2 \times Pi$$

$$S_2 \times Pe = s_1 \times Pe$$

which implies $$S_1 = S_2 = s_1 = s_2$$

Figure 3:
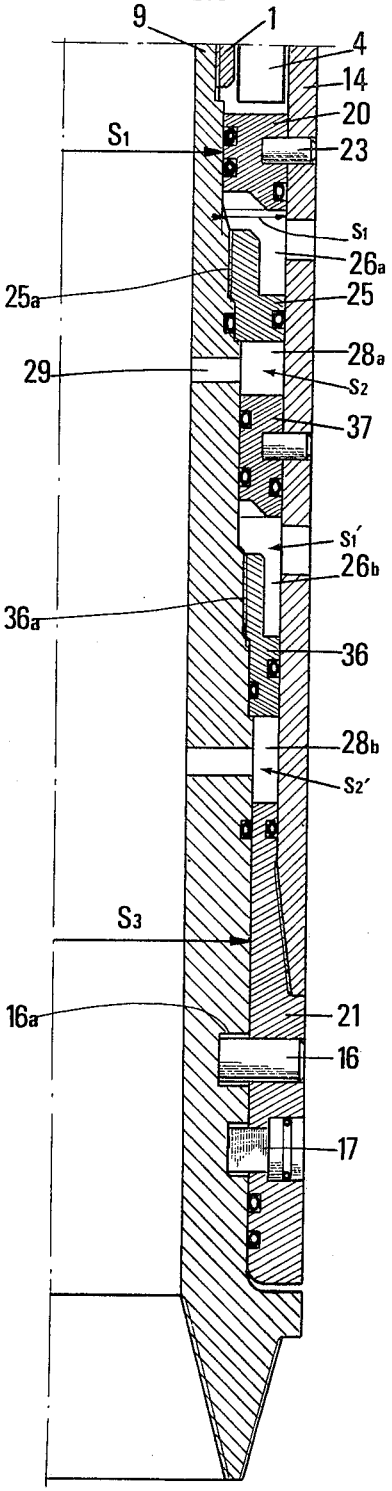
FIG. 3 shows a further embodiment which is particularly suitable for small diameter drill columns.

FIG. 3 illustrates another embodiment which differs from that shown in FIG. 1 by a duplication of each of the annular chambers 26 and 28 (annular chambers 26*a* and 26*b* having the annular operative cross-sections $s_1$ and $s'_1$ respectively, which communicate with the space outside the downhole assembly of the drill pipe, and annular chambers 28*a* and 28*b* having the annular operative cross-sections $s_2$ and $s'_2$ respectively, which communicate with the space inside the lower portion of the drilling column).

The annular spaces 26*a* and 28*a* are arranged on both sides of the piston 25, and the annular spaces 26*b* and 28*b* are on both sides of an additional annular piston 36 which is located between the annular piston 20*a* and the annular element 21, and is connected to the conduit 9 by the threads 36*a*. A piston 37, integral with the sleeve 14, and permitting the sliding movement of the conduit 9, separates the chamber 28*a* from the chamber 26*b*.

In this embodiment, the compensation of the effect of the hydrostatic pressure and of the pressure difference between the inner and outer spaces at the lower end of the drill column is obtained by designing the device so that $$s_2 + s'_2 = S_1$$

$$s_1 + s'_1 = S_3$$

This device may be of particular interest in the case of small-diametered drilling columns, the above double condition being then more easily satisfied than the two separate conditions $$s_2 = S_1$$

and $$s_1 = S_2$$

as applied to the embodiment shown in FIG. 1.

What is claimed is:

1. A new device for measuring the stresses applied to the downhole assembly of a drill pipe, said device comprising measuring means operatively associated with at least one resilient member interconnecting two adjacent conduits which can respectively be coupled to an upper and to a lower part of said downhole assembly, a sleeve integral with one of said conduits and for protecting said resilient member against external radial pressure, wherein said conduits have substantially the same diameter at their adjacent ends, and wherein said sleeve and one of said conduits form the lateral walls of an annular space which houses at least one intermediate annular piston, said annular space limited by two annular elements forming the end walls thereof, said annular elements being integral with a first of said lateral walls, and slidable along the second of said walls, while said annular piston is integral with the second lateral wall and is slidable along said first wall, said piston separating two annular chambers, one of which communicates with the space outside the downhole assembly of the drill string, and the other communicating with the inner space of said downhole assembly, the operative annular cross-sections of said chambers on both sides of said piston being selected, in dependence on the values of the internal diameter of said annular space at the respective levels of the end walls thereof, so as to substantially nullify any axial load resulting from a pressure difference between the inner and the outer space of the downhole assembly of the drill pipe.

2. A device according to claim 1, comprising a single intermediate piston separating two annular chambers, the operative cross-section of each of said chambers in the vicinity of said piston being equal to the outer cross-section of said conduit which forms one of the lateral walls of said annular space measured at the level of the end wall of said annular space which is located on the other side of said piston with respect to said chamber.

3. A device according to claim 1, comprising three intermediate annular pistons (25, 37, 36) separating said annular space into four annular chambers (26*a*, 28*a*, 26*b*, 28*b*) each two of said chambers located respectively on both sides of a single one of said annular pistons respectively communicating with the outer and with the inner spaces of the downhole assembly of the drill pipe, the sum of the areas of the operative annular sections of the chambers communicating with said outer space being substantially equal to the area of the outer cross-section of said conduit constituting one of the lateral walls of said annular space, measured at the level of the end wall of said space which limits an annular chamber in communication with said inner space, and the sum of the areas of the operative annular sections of the chambers communicating with said inner space being substantially equal to the area of the outer cross-section of said conduit, measured at the level of the end wall of said space which limits an annular chamber in communication with said outer space on the downhole assembly of the drill pipe.

* * * * *